US008166611B2

(12) United States Patent
Moon

(10) Patent No.: US 8,166,611 B2
(45) Date of Patent: May 1, 2012

(54) DOOR SUPPORTING DEVICE FOR REFRIGERATOR

(75) Inventor: Sun-Nam Moon, Changwon (KR)

(73) Assignee: LG Electronics Inc., Seoul (KR)

( * ) Notice: Subject to any disclaimer, the term of this patent is extended or adjusted under 35 U.S.C. 154(b) by 397 days.

(21) Appl. No.: 12/162,580

(22) PCT Filed: Feb. 15, 2006

(86) PCT No.: PCT/KR2006/000529

§ 371 (c)(1),
(2), (4) Date: Jul. 29, 2008

(87) PCT Pub. No.: WO2007/094523

PCT Pub. Date: Aug. 23, 2007

(65) Prior Publication Data

US 2009/0038117 A1 Feb. 12, 2009

(51) Int. Cl.
*E05D 7/06* (2006.01)

(52) U.S. Cl. ..... 16/240; 16/238; 16/250

(58) Field of Classification Search ..... 411/160, 411/235, 238, 240, 241–245, 250, 273, DIG. 7; 49/381; 62/531; 312/326, 329, 405
See application file for complete search history.

(56) References Cited

U.S. PATENT DOCUMENTS 157,618 A * 12/1874 Mantey ..... 16/2.4
RE8,483 E * 11/1878 Thompson ..... 16/2.4
391,891 A * 10/1888 Fox et al. ..... 16/2.4
3,531,824 A * 10/1970 Hagendoorn ..... 16/222
3,592,257 A * 7/1971 Matyas ..... 160/186
4,070,728 A * 1/1978 Herman ..... 16/243
(Continued)

FOREIGN PATENT DOCUMENTS

JP 09-033161 A 2/1997
(Continued)

*Primary Examiner* — Victor Batson
*Assistant Examiner* — Roberta Delisle
(74) *Attorney, Agent, or Firm* — Birch, Stewart, Kolasch & Birch, LLP

(57) ABSTRACT

The present invention relates to a door supporting device for a refrigerator. The door supporting device of the present invention can adjust the height of the door. A hinge bracket of the door supporting device of the present invention includes a fixing portion fixed to a front face of the refrigerator, and a supporting portion extending forward from an upper end of the fixing portion and having a threaded hole with threads formed on an inner periphery thereof. A hinge shaft of the door supporting device has threads on an outer periphery thereof and is threadly engaged with the threaded hole so that the hinge shaft can be supported by the hinge bracket. An upper end of the hinge shaft rotatably supports the door. The height of the door can be adjusted by rotating the hinge shaft. A nut is threadly engaged with the hinge shaft below the hinge bracket. The nut prevents the hinge shaft from being rotated so that the door can be constantly maintained at a predetermined height. The door supporting device further comprises a hinge cap fitted around the upper end of the hinge shaft and inserted into a hinge hole formed in a bottom surface of the door so as to rotatably support the door. The hinge cap comprises a rearward extension and a rotation preventing projection extending downward from the extension, and the rotation preventing projection is inserted into a fixing hole of the hinge bracket so as to restrict rotation of the hinge cap.

8 Claims, 4 Drawing Sheets

U.S. PATENT DOCUMENTS

| | | | | |
|---|---|---|---|---|
| 5,369,842 | A * | 12/1994 | Beatty | 16/317 |
| 6,138,341 | A * | 10/2000 | Barroero et al. | 29/527.1 |
| 2005/0262663 | A1* | 12/2005 | Lee | 16/221 |
| 2006/0143860 | A1* | 7/2006 | Park et al. | 16/243 |

FOREIGN PATENT DOCUMENTS

| | | | |
|---|---|---|---|
| KR | 20-1999-0018256 | U | 6/1999 |
| KR | 20-0169564 | Y1 | 2/2000 |
| KR | 20-0338112 | Y1 | 12/2003 |

* cited by examiner

DOOR SUPPORTING DEVICE FOR REFRIGERATOR

TECHNICAL FIELD

The present invention relates to a refrigerator having a height-adjustable door, and more particularly, to a refrigerator having a height-adjustable door, which is constructed such that the height of the door can be easily adjusted and the door can also be supported without any change in its height even though it is used for a long period of time.

BACKGROUND ART

FIG. 1 is a perspective view showing the structure of a typical side-by-side type refrigerator, and FIG. 2 is a sectional view illustrating a supporting structure for a door of a conventional refrigerator. As shown in FIG. 1, a main body 10 of the typical refrigerator has a refrigerating chamber 12 and a freezing chamber 14, which have open front faces, as storage spaces to store foodstuffs in a refrigerated state and a frozen state, respectively.

Further, the open front faces of the refrigerating chamber 12 and the freezing chamber 14 are opened and closed by a refrigerating chamber door 22 and a freezing chamber door 24, respectively. Each of the doors 22 and 24 is pivotably supported at upper and lower ends of either side of the door at a front face of the main body. That is, as shown in FIG. 2, a lower end surface of each of the doors 22 and 24 is formed with a hinge hole 26. In addition, a bracket 30 is fixed to a lower end of the front face of the main body 10 by means of a fixing means such as a fixing screw or bolt 32.

Further, the bracket 30 has a vertical fixing portion 30*a* fixed to the lower end of the front face of the main body, and a horizontal supporting portion 30*b* extending in a generally horizontal direction and forward from an upper end of the vertical fixing portion 30*a*. The horizontal supporting portion 30*b* of the bracket 30 is a portion that substantially supports each of the doors 22 and 24. A hinge bush 34 with a hinge shaft 34*a* that is inserted into the hinge hole 26 to pivotably support each of the doors 22 and 24 is fixed to an upper surface of the horizontal supporting portion 30*b* of the bracket 30. The hinge bush 34 may be configured variously so far as it can be fixed to and supported by the horizontal supporting portion 30*b* of the hinge bracket 30. Referring to the exemplary configuration of the hinge bush in the illustrated embodiment, the hinge shaft 34*a* of the hinge bush 34 is formed in a hollow shape, and is supported by inserting a supporting projection 30*c* extending upward from the upper surface of the horizontal supporting portion 30*b* of the hinge bracket 30 into the hollow of the hinge shaft. Further, if necessary, it is also possible to add an additional means for fixing the hinge bush 34 to the upper surface of the hinge bracket 30.

FIG. 2 shows the conventional exemplary configuration in which the lower end of each of the doors 22 and 24 is supported pivotably. Thus, the bracket 30 with the hinge bush 34 installed thereon pivotably supports each of the doors 22 and 24 while bearing up the weight of each of the doors 22 and 24. Further, although not shown, an upper end of each of the doors 22 and 24 is also pivotably supported similarly to the lower end of the door.

In the conventional refrigerator thus constructed, there is a disadvantage in that the freezing chamber door 24 and the refrigerating chamber door 22 may not be horizontally disposed at the same level due to assembly tolerance between the main body and the doors when they are assembled with each other, or either one of the doors 22 and 24 may be sagged downwardly due to fatigue loads resulting from repeated opening and closing of the doors by a user for a long period of time. That is, in the side-by-side type refrigerator shown in FIG. 1, it is preferred that the doors 22 and 24 be installed side by side with each other so that the both doors can be horizontally disposed at the same level. However, as described above, there are problems in that the case where the both doors are not horizontally disposed at the same level due to the assembly tolerance in an assembling process may occur, and the doors 22 and 24 may not be maintained in the horizontal state but sagged due to the weights of the doors and fatigue loads resulting from the repeated opening and closing of the doors during the use thereof for a long period of time, thereby causing variation in their heights.

Moreover, since the doors 22 and 24 of the conventional refrigerator have heights fixed at an initial assembly stage, there is a troublesome and inconvenient problem in that upon occurrence of the height deviation between the doors 22 and 24, the entire doors 22 and 24 are separated from the main body 10 and the position of the hinge bracket 30 should be corrected in order to correct the height variation.

It is preferred that a door of a refrigerator be maintained in a horizontal state. Particularly, since a pair of doors are installed side by side in a side-by-side type refrigerator, maintaining the doors in a horizontal state and at the same level is greatly required.

DISCLOSURE

Technical Problem

An object of the present invention is to provide a refrigerator capable of adjusting the height of a door while the door is mounted.

Another object of the present invention is to provide a refrigerator capable of constantly maintaining the heights of both side doors during the use thereof for a long period of time without variation in the heights of the doors.

Technical Solution

According to an aspect of the present invention for achieving the objects, there is provided a door supporting device for a refrigerator including a main body having a storage space with an open front face and a door for opening and closing the storage space. The door supporting device comprises a hinge bracket including a fixing portion fixed to a front face of the refrigerator, and a supporting portion extending forward from an upper end of the fixing portion and having a threaded hole with threads formed on an inner periphery thereof; a hinge shaft that has threads on an outer periphery thereof, is threadly engaged with the threaded hole so that the hinge shaft can be supported by the hinge bracket, and has an upper end for rotatably supporting the door; and a nut threadly engaged with the hinge shaft below the hinge bracket.

According to the present invention thus constructed, the nut is tightened to come into close contact with a bottom surface of the hinge bracket so that the rotation of the hinge shaft caused by impacts generated due to rotation or opening/closing of the door can be prevented. Thus, it will be apparent that the height of the door can be adjusted in upward and downward directions by means of the rotation of the hinge shaft.

In an embodiment of the present invention, the door supporting device further comprises a hinge cap fitted around the upper end of the hinge shaft and inserted into a hinge hole formed in a bottom surface of the door so as to rotatably support the door. Preferably, the hinge cap is formed of a synthetic resin material.

In an embodiment of the present invention, the hinge cap comprises a rearward extension and a rotation preventing projection extending downward from the extension, and the rotation preventing projection is inserted into a fixing hole of the hinge bracket so as to restrict rotation of the hinge cap.

With the structure of the hinge cap, the hinge cap prevents the occurrence of noise due to friction upon opening/closing of the door and is not rotated with respect to the hinge bracket, thereby preventing unscrewing between the hinge shaft and the bracket due to the rotation of the door.

In an embodiment of the present invention, a portion of the hinge shaft above the hinge bracket is formed with a radially extending support flange, and the support flange comes into contact with and supports a lower end of the hinge cap.

A washer is preferably fitted around the hinge shaft between the nut and the hinge bracket.

Preferably, the threaded hole is formed in a socket fixedly inserted into a supporting hole formed in the supporting portion of the hinge bracket.

It is preferred that the socket may comprise a body portion inserted into the supporting hole, and a flange portion radially extending from a lower end of the body portion and brought into close contact with a bottom surface of the supporting portion of the hinge bracket.

The refrigerator may be a side-by-side type refrigerator with a pair of doors installed side by side.

According to another aspect of the present invention, there is provided a door supporting device for a refrigerator including a main body having a storage space with an open front face and a door for opening and closing the storage space. The door supporting device comprises a hinge bracket including a fixing portion fixed to a front face of the refrigerator, and a supporting portion extending forward from an upper end of the fixing portion and having a threaded hole with threads formed on an inner periphery thereof; a hinge shaft having threads on an outer periphery thereof and threadly engaged with the threaded hole so that the hinge shaft can be supported by the hinge bracket; a hinge cap having a hinge shaft portion that is coupled with an upper portion of the hinge shaft and inserted into a hinge hole formed in a bottom surface of the door so as to rotatably support the door; a first restriction means for preventing the hinge cap from being rotated with respect to the bracket; and a second restriction means engaged with the hinge shaft so as to prevent the hinge shaft from being rotated with respect to the bracket.

Advantageous Effects

According to the present invention described above, it can be expected to obtain the following advantages.

First, it is possible to adjust the height of a door by rotating the hinge shaft 140. Therefore, it is possible to adjust the height of the door even in a state where the door is mounted on a main body of a refrigerator. Particularly, in a side-by-side type refrigerator, the heights of doors of the refrigerator which are installed side by side can be adjusted to be at the same level.

Further, according to the present invention, it can be understood that the hinge cap is constructed not to be rotated and the nut is engaged with the lower portion of the hinge shaft 140 so that the rotation of the hinge shaft 140 caused by external forces can be substantially prevented. With such a structure, the hinge shaft is not rotated by an external force. Thus, the door can be maintained at a predetermined height as it is, resulting in improved reliability of a product.

BEST MODE

Hereinafter, the present invention will be described in detail with reference to preferred embodiments shown in the accompanying drawings.

Figure 1:
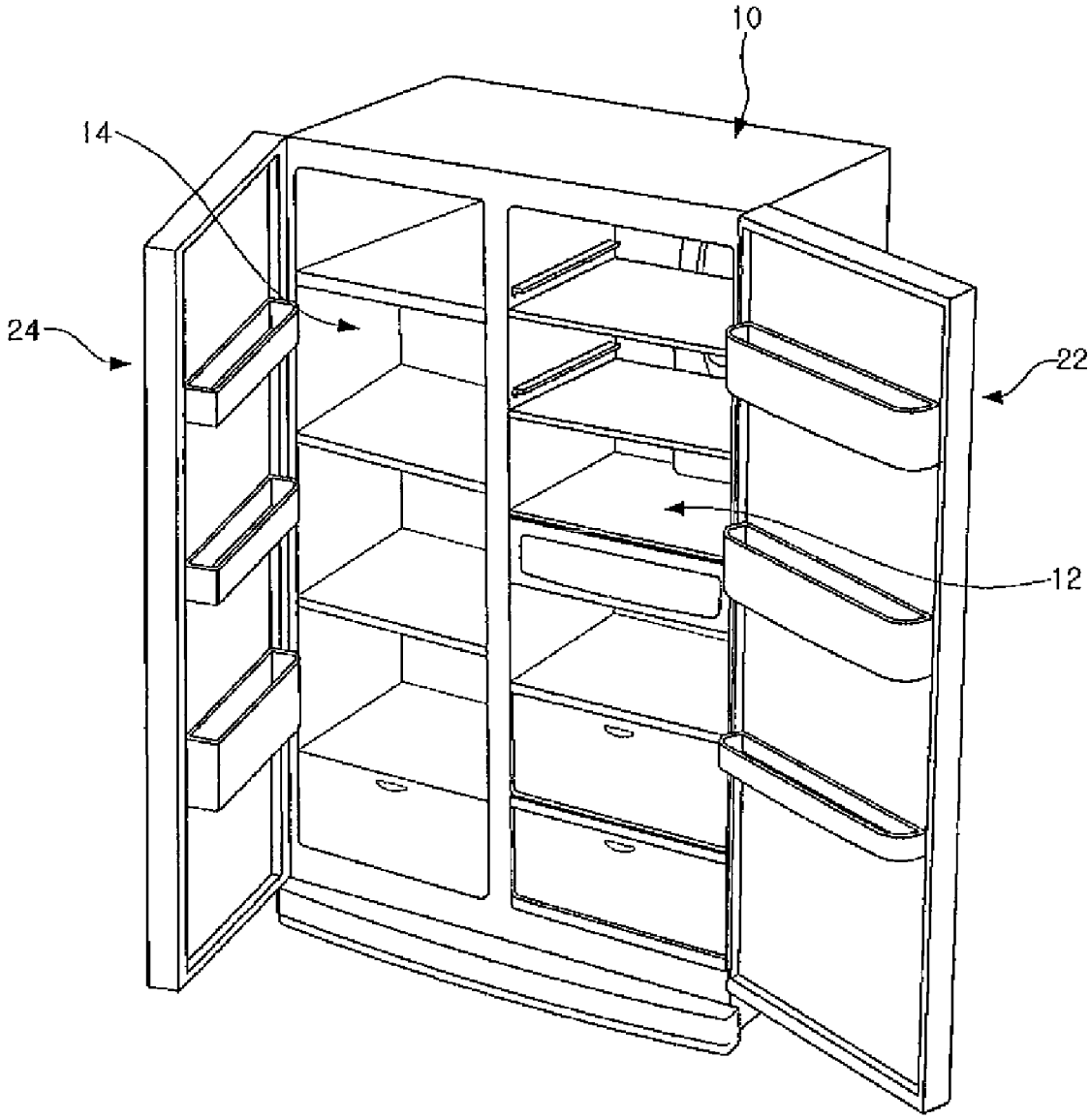
FIG. 1 is a perspective view showing the structure of a typical refrigerator.
Figure 2:
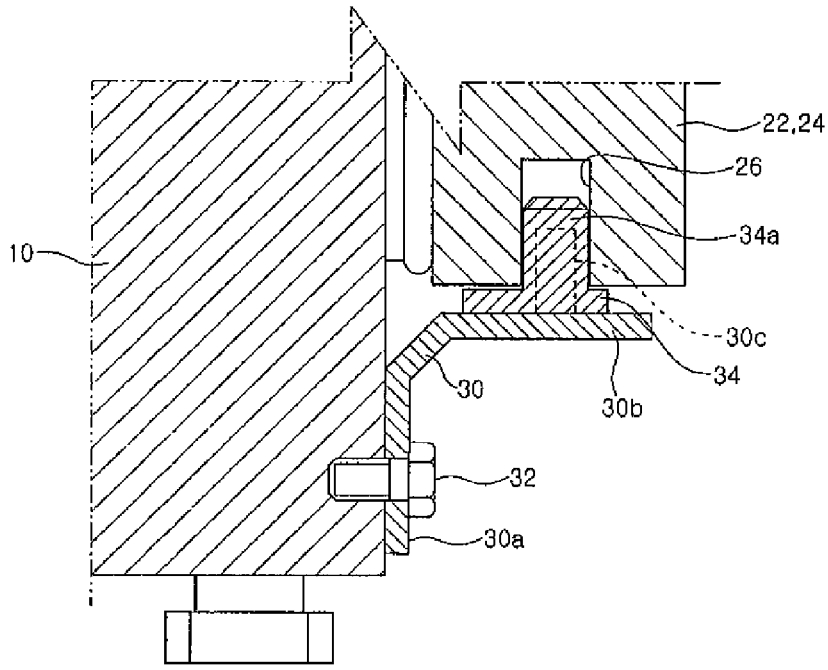
FIG. 2 is a sectional view illustrating a supporting structure for a door of a conventional refrigerator.
Figure 3:
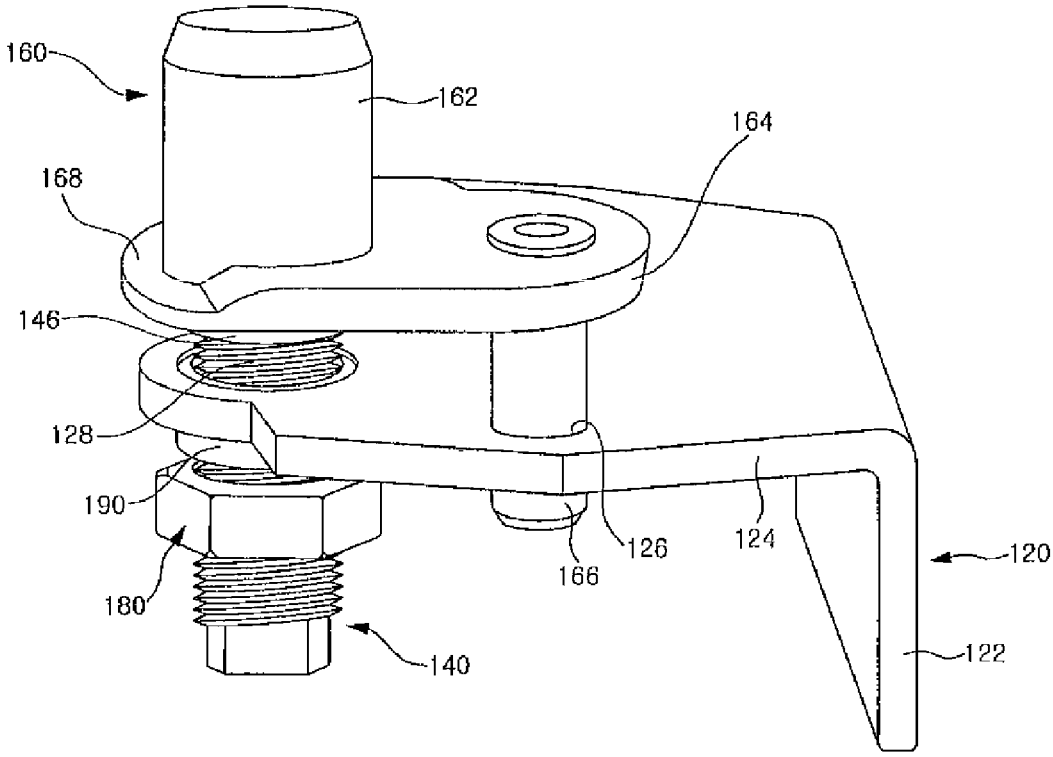
FIG. 3 is a side perspective view showing a door supporting device for a refrigerator according to the present invention.
Figure 4:
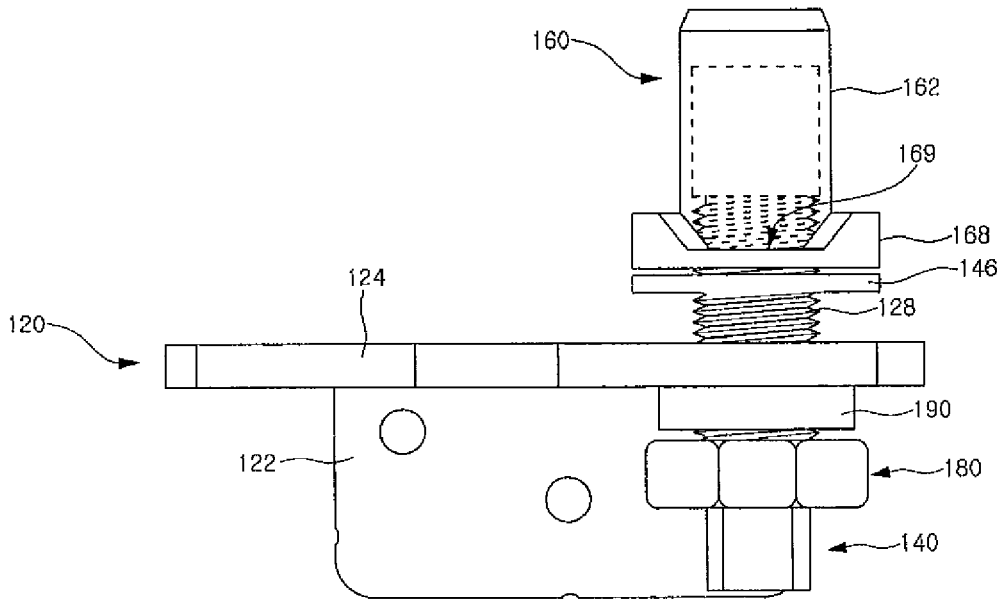
FIG. 4 is a front view showing the door supporting device for a refrigerator according to the present invention.
Figure 5:
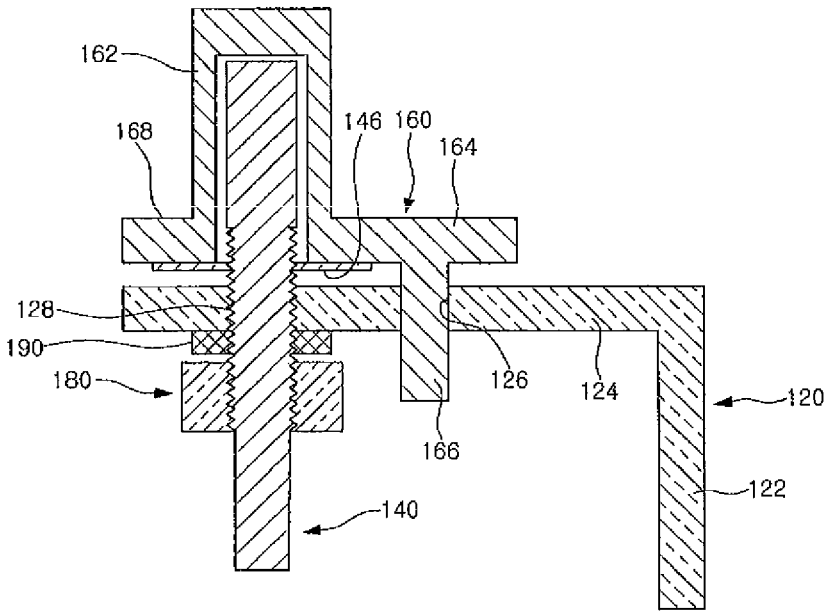
FIG. 5 is a sectional view illustrating the door supporting device for a refrigerator accroding to the present invention.

FIG. 3 is a side view of a hinge device for pivotably supporting a door of a refrigerator according to the present invention, FIG. 4 is a front view of the hinge device for pivotably supporting a door of a refrigerator according to the present invention, and FIG. 5 is a sectional view illustrating the hinge device according to the present invention.

A refrigerator to which the present invention is applied comprises a main body including a freezing chamber and a refrigerating chamber, and doors for opening and closing the freezing chamber and the refrigerating chamber of the main body. Each of the doors of the freezing and refrigerating chambers is pivotably supported at upper and lower ends of either side of the door, and the hinge device shown in FIGS. 3 to 5 is to substantially support the lower end of each of the doors of the refrigerator.

The hinge device according to the present invention comprises a hinge bracket 120 for supporting the door on the main body of the refrigerator, and a hinge shaft 140 supported by the hinge bracket 120 such that it can be raised or lowered.

The hinge bracket 120 is preferably formed of a metallic material, and is coupled to the main body of the refrigerator so that the hinge bracket can bear up the weight of the door. The hinge bracket 120 comprises a fixing portion 122 fixed to a lower portion of a front face of the main body of the refrigerator, and a supporting portion 124 extending forward from an upper end of the fixing portion 122. In addition, the fixing portion 122 of the hinge bracket 120 is a portion that is fixed to and supported by the lower portion of the front face of the refrigerator, for example, by means of a screw or bolt, and is formed to take the shape of a vertical plate. The supporting portion 124 extending forward from the upper end of the fixing portion 122 is a portion that substantially bears up the weight of the door, and extends forward in a horizontal direction. A threaded hole 128 of which an inner periphery is formed with female threads to be threadly engaged with the hinge shaft 140 is formed at a front side of the supporting portion 124. The supporting portion 124 is formed with a fixing hole 126 at a rear side with respect to the threaded hole 128.

Further, the hinge shaft 140 is formed with threads on an outer periphery thereof so that the hinge shaft is threadly engaged with the threaded hole 128 of the hinge bracket 120. Thus, the rotation of the hinge shaft 140 allows the hinge shaft 140 to be moved upward and downward by a predetermined distance. The threaded portion in the hinge shaft 140 substantially corresponds to the distance by which the hinge shaft is moved upward and downward (the distance corresponds to a distance by which the door is adjusted upward and downward). In addition, the rotational adjustment of the hinge shaft 140 can be facilitated, for example, by forming a lower end of the hinge shaft 140 in a hexagonal head shape.

A hinge cap 160 is coupled with an upper portion of the hinge shaft 140 that is engaged with the threaded hole of the hinge bracket 120. The hinge cap 160 is provided with a hinge shaft portion 162 that is inserted into a hinge hole formed in a bottom surface of the door of the refrigerator and thus substantially supports the door to be pivotable. The hinge shaft portion 162 is formed to have a substantially hollow shape so that an upper end of the hinge shaft 140 can be received in the hollow.

Further, the hinge cap 160 has a rearward extension 164, and a rotation preventing projection 166 that is formed to extend downward from a bottom surface of the extension 164. The rotation preventing projection 166 is inserted into the fixing hole 126 of the hinge bracket 120. The rotation preventing projection 166 is to prevent the hinge cap 160 from being rotated together with the door of the refrigerator when the door is opened and closed.

The hinge cap 160 is preferably formed of a synthetic resin material. That is, the hinge cap 160 is formed of a synthetic resin material in order to prevent generation of noise by friction upon rotation of the door. In addition, since the rotation preventing projection 166 of the hinge cap 160 is inserted into the fixing hole 126 of the hinge bracket 120, the hinge cap is supported by the hinge bracket 120 fixed to the main body of the refrigerator so that the hinge cap can be maintained in a state where it is substantially prevented from being rotated together with the door upon rotation of the door. Further, an outward extending flange portion 168 is formed at a lower end of the hinge shaft portion 162 of the hinge cap 160. As more clearly shown in FIG. 4, the flange portion 168 of the hinge cap 160 is provided with a groove 169 of which both sides are inclined. The groove 169 is to perform an auto-closing function. That is, the groove cooperates with a structure on the bottom surface of the door of the refrigerator so that the door can be closed by being automatically moved toward the main body when the door is pivoted through a predetermined range.

It can be noted that the hinge cap 160 is engaged with the upper end of the hinge shaft 140 and substantially supports the rotation of the door. Thus, when the hinge shaft 140 is moved upward or downward by a predetermined distance upon rotation thereof with respect to the hinge bracket 120 in a fixed state, the hinge cap 160 is also moved upward or downward by a predetermined distance.

In the illustrated embodiment, an outward extending support flange 146 is formed at an intermediate portion of the hinge shaft 140 above the hinge bracket 120. The support flange 146 substantially supports a bottom surface of the flange portion 168 of the hinge cap 160, so that the hinge cap 160 can be moved upward or downward in accordance with the upward or downward movement of the hinge shaft 140. It will be apparent that in a case where the support flange 146 is not formed, the hinge cap 160 can cooperate with the hinge shaft 140 in such a manner that the upper end of the hinge shaft 140 pushes the inside of the hinge shaft portion 162 of the hinge cap 160 in an upward direction.

As described above, according to the present invention, it can be understood that the hinge cap 160 is configured to be moved upward or downward by a predetermined distance by means of the rotation of the hinge shaft 140. In addition, since the rotation preventing projection 166 of the hinge cap 160 is inserted into the fixing hole 126 of the hinge bracket 120, the hinge cap is substantially prevented from being rotated in response to the rotation of the door. That is, it can be understood that since the hinge cap 160 is maintained in a fixed state by the hinge bracket 120, the hinge shaft 140 is maintained not to be rotated in response to the opening and closing of the door.

However, for example, storage of many foodstuffs in a door basket provided on rear surface of the door, or impacts generated due to repeated opening and closing of the door may cause an unscrewing phenomenon of the hinge shaft 140. Since the thread portion formed on the outer periphery surface of the hinge shaft 140 comprises substantially triangular threads, a slightly unscrewing phenomenon of the thread portion may be caused by external forces such as repeated impacts. If this phenomenon is repeated, there is a problem in that the height of the door may be substantially lowered by means of the rotation of the hinge shaft 140.

Therefore, in order to prevent the door from being sagged by means of fatigue loads such as impacts generated due to the opening and closing of the door, the door supporting device of the present invention comprises a means for preventing the rotation of the hinge shaft 140.

As shown in the figures, a nut 180 is engaged with a lower portion of the hinge shaft 140. The nut 180 is installed to be threadly engaged with the portion of the hinge shaft 140 below the hinge bracket 120, so that the nut can prevent the hinge shaft 140 from being arbitrarily rotated. That is, once the aforementioned hinge device is coupled with the main body of the refrigerator at the front face of the main body and each of the doors is then completely assembled, the heights of the pair of doors can be maintained at the substantially same level. In this state, the nut 180 is tightened and then brought into close contact with a bottom surface of the supporting portion 124 of the hinge bracket 120. Then, the nut 180 can maintain the hinge shaft 140 in a completely confined state so that the hinge shaft cannot be arbitrarily rotated. When the nut 180 is tightened to be brought into close contact with the bottom surface of the bracket, the hinge shaft 140 cannot be rotated substantially. The fact that the hinge shaft 140 is supported not to be rotated means that the door supported by the hinge cap 160 cannot be sagged substantially in any case.

According to the present invention thus constructed, it can be understood that in order to prevent the door from being sagged due to repetition of slight rotation of the hinge shaft 140, there is provided a dual rotation-preventing means by constructing the hinge cap 160 of which rotation is prevented by the bracket 120 and fastening the nut to the hinge shaft. Further, a washer 190 is fitted around the hinge shaft 140 between the nut 180 and the hinge bracket 120. It is apparent that the washer 190 is interposed to increase a fastening force by means of friction and to securely maintain the fastened state.

According to the present invention thus constructed, the rotation of the hinge shaft that may be caused by the opening and closing of the door can be completely prevented by means of the hinge cap and the nut. Thus, even in a case where there are external forces such as impacts generated due to the repeated opening and closing of the door for a long time, the upward or downward movement of the hinge shaft can be entirely avoided. This means that the substantial sag phenomenon of the door due to unscrewing between the hinge shaft and the bracket which are threadly engaged with each other can be completely prevented.

Further, in the present invention, the hinge shaft 140 can be rotated in response to user's operation at any time. That is, the height of the door is adjustable in upward and downward directions within a predetermined range by means of the rotation of the hinge shaft. To this end, after the nut 180 is released from the fastened state to the bracket 120 by unscrewing and lowering the nut 180, the hinge shaft 140 can be rotated. The movement of the hinge shaft 140 in the upward or downward direction by a desired distance can be considered as substantial adjustment of the height of the door. Further, it will be apparent that after the height of the door is adjusted by rotating the hinge shaft 140, the nut 180 should be tightened again to be brought into close contact with the bottom surface of the hinge bracket 120.

Mode for Invention

Figure 6:
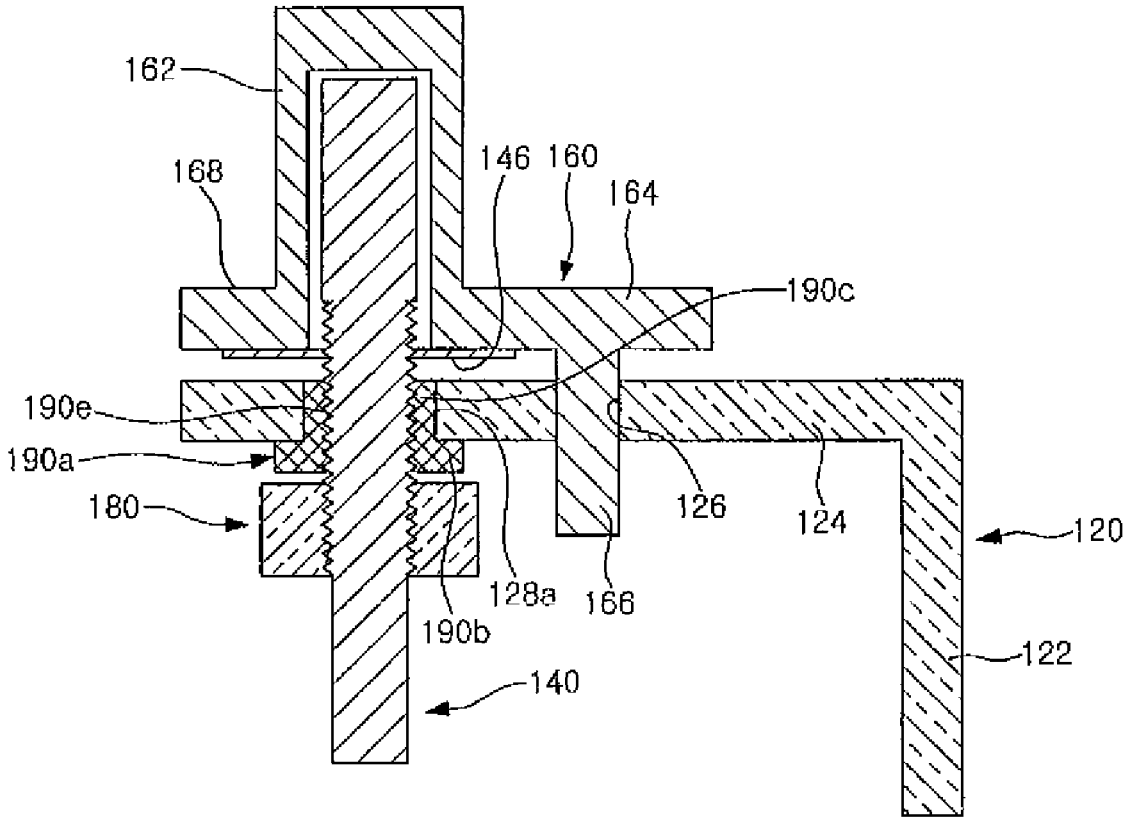
FIG. 6 is a sectional view illustrating a door supporting device for a refrigerator according to another embodiment of the present invention.

Next, another embodiment of the present invention shown in FIG. 6 will be described. In this embodiment, components identical with those of the previous embodiment will be designated by identical reference numerals, and descriptions overlapping with those of the previous embodiment will be omitted. This embodiment is configured to improve convenience in machining a hinge bracket.

As shown in the figure, a hinge bracket 120 comprises a fixing portion 122 fixed to a lower end of a front surface of a refrigerator, and a supporting portion 124 extending forward from an upper end of the fixing portion 122 in a horizontal direction. The supporting portion 124 is formed with a fixing hole 126 into which a rotation preventing projection 166 of a hinge cap 160 is inserted. Further, a supporting hole 128*a* into which a socket 190*a* to be described later is to be fixedly inserted is formed at a front side with respect to the fixing hole 126 of the supporting portion 124. In this embodiment, the socket 190*a* is inserted into the supporting hole 128*a* and is fixed thereto by means of welding, and a central through-hole of the socket 190*a* is formed with a threaded portion 190*e* threadly engaged with the hinge shaft 140. In the illustrated embodiment, the socket 190*a* comprises a body portion 190*c* which is tightly inserted into the supporting hole 128*a*, and a flange portion 190*b* radially extending from a lower end of the body portion 190*c* and is brought into close contact with a bottom surface of the hinge bracket 120. Therefore, the socket 190*a* can be securely fixed to the hinge bracket 160 by inserting the body portion 190*c* into the supporting hole 128*a* and partially welding the flange portion 190*b* to the supporting portion 124 of the hinge bracket 120.

When the socket 190*a* is fixed in such a manner, the hinge shaft 140 is threadly engaged with the socket 190*a*, and the hinge shaft 140 can be moved upward or downward by a predetermined distance by means of the rotation thereof. As described above, the upward or downward movement of the hinge shaft 140 allows the height of the door to be substantially adjusted via the hinge cap 160.

In this embodiment, it can be understood that the additional socket 190*a* that is separately machined is fixed to the supporting hole 128*a* of the hinge bracket 120. Accordingly, since the hinge bracket 120 is merely formed with the supporting hole 128*a* and the fixing hole 126, the process of forming the hinge bracket 120 can be very easily performed.

Industrial Applicability

According to the present invention described above, it can be understood that the technical spirit of the present invention is to adjust the height of a door by rotating the hinge shaft 140 and to completely prevent the rotation of the hinge shaft 140 due to external forces. It will be apparent to those skilled in the art that various changes and modifications can be made thereto within the fundamental technical spirit and scope of the present invention, and the present invention should be construed on the basis of the appended claims.

The invention claimed is:

1. A door supporting device for a refrigerator including a main body having a storage space with an open front face and a door for opening and closing the storage space, comprising:

a hinge bracket including a fixing portion fixed to a front face of the refrigerator, and a supporting portion extending forward from an upper end of the fixing portion and having a threaded hole with threads formed on an inner periphery thereof, and a fixing hole formed between the threaded hole and the fixing portion;

a hinge shaft having threads on an outer periphery thereof and threadedly engaged with the threaded hole of the hinge bracket so that the hinge shaft can be supported by the hinge bracket, and a bolt head formed on a lower end of the hinge shaft;

a hinge cap having a hinge shaft portion configured to be inserted into a hinge hole formed in a bottom surface of the door of the refrigerator so as to rotatably support the door and formed to have a substantially hollow shape so that the upper end of the hinge shaft can be received in the hollow;

a rearward extension on the hinge cap; and a rotation preventing projection extending downward from the rearward extension and being inserted into the fixing hole of the hinge bracket so as to restrict rotation of the hinge cap.

2. The door supporting device as claimed in claim 1, wherein a portion of the hinge shaft above the hinge bracket is formed with a radially extending support flange, and the support flange comes into contact with and supports a lower end of the hinge cap.

3. The door supporting device as claimed in claim 1, further comprising a washer fitted around the hinge shaft between the nut and the hinge bracket.

4. The door supporting device as claimed in claim 1, wherein the threaded hole is formed in a socket fixedly inserted into a supporting hole formed in the supporting portion of the hinge bracket.

5. The door supporting device as claimed in claim 4, wherein the socket comprises a body portion inserted into the supporting hole, and a flange portion radially extending from a lower end of the body portion and brought into close contact with a bottom surface of the supporting portion of the hinge bracket.

6. The door supporting device as claimed in claim 1, wherein the hinge cap is formed of a synthetic resin material.

7. The door supporting device as claimed in claim 1, wherein the refrigerator is a side-by-side type refrigerator with a pair of doors installed side by side.

8. The door supporting device as claimed in claim 1, further comprising a nut threadedly engaged with a lower portion of the hinge shaft below the hinge bracket to prevent the hinge shaft from being arbitrarily rotated.

* * * * *